US006167589B1

(12) United States Patent
Luedtke

(10) Patent No.: US 6,167,589 B1
(45) Date of Patent: Jan. 2, 2001

(54) CONTROL MECHANISM INCLUDING A PERMANENT MAGNET SYSTEM

(76) Inventor: Daren J. Luedtke, 2435-A N. Humboldt Blvd., Milwaukee, WI (US) 53212

( * ) Notice: Under 35 U.S.C. 154(b), the term of this patent shall be extended for 0 days.

(21) Appl. No.: 09/276,781

(22) Filed: Mar. 25, 1999

(51) Int. Cl.[7] ..... E05F 1/00
(52) U.S. Cl. ..... 16/71; 16/49; 16/82
(58) Field of Search ..... 16/71, 78, 72, 16/82–85, 66, 67, 49, 320; 49/381, 386, 394, 404, 405; 292/206.5, 309.4

(56) References Cited

U.S. PATENT DOCUMENTS

| | | | | |
|---|---|---|---|---|
| 3,346,993 | * | 10/1967 | Johnson | 16/320 |
| 3,691,688 | * | 9/1972 | Kaiserswerth | 49/394 |
| 4,115,897 | | 9/1978 | Zunkel . | |
| 4,434,524 | * | 3/1984 | Gilchrist | 16/280 |
| 4,506,407 | | 3/1985 | Downey . | |
| 4,670,939 | | 6/1987 | Fisher . | |
| 4,920,609 | | 5/1990 | Lin . | |
| 5,251,402 | | 10/1993 | Richardson et al. . | |
| 5,471,708 | | 12/1995 | Lynch . | |
| 5,517,719 | | 5/1996 | Christ . | |
| 5,529,148 | | 6/1996 | O'Leary . | |
| 5,592,780 | * | 1/1997 | Checkovich | 16/49 |
| 5,630,248 | | 5/1997 | Luca . | |
| 5,803,404 | | 9/1998 | Petrou et al. . | |
| 5,832,562 | | 11/1998 | Luca . | |

* cited by examiner

*Primary Examiner*—Chuck Y. Mah
(74) *Attorney, Agent, or Firm*—Reinhart, Boerner, Van Deuren, Norris & Rieselbach, s.c.

(57) ABSTRACT

A control mechanism includes a set of permanent magnets located within a cylindrical housing, the magnets being carried on a shaft which extends within the housing and is movable axially relative to the housing. The magnets are arranged in repulsion configuration and are coupled to the shaft and moved together as the shaft is moved relative to the housing manually from a stationary or retracted position to an extended position. Upon release of the shaft, repulsion forces produced by the magnets cause the magnets to move apart, moving the shaft relative to the housing from the extended position to the retracted position. In one embodiment, the control mechanism is coupled between a door and a door frame and operates as a door closer. In other embodiments, the control mechanism operates as an opening mechanism for opening the cover of a container, the opening mechanism also acting as a closer as the cover is being closed, to assist in closing the cover.

40 Claims, 5 Drawing Sheets

CONTROL MECHANISM INCLUDING A PERMANENT MAGNET SYSTEM

BACKGROUND OF THE INVENTION

This invention relates generally to control mechanisms for controlling the closing or opening of doors or windows or the like of structures and/or vehicles, and more particularly, to a control mechanism of this type which includes a permanent magnet system.

Closing and opening mechanisms for doors or windows of buildings or vehicles, for example, typically include spring mechanisms, or pneumatic or hydraulic piston/cylinder devices. For example, door closers are used to return an opened door, typically a storm door or a screen door, to a closed position. Known door closers generally include a cylindrical tube having an end attachable to a door or a door frame. The cylindrical tube or cylinder contains a piston on a rod with an end extending from the free end of the tube. The extending end of the rod is attachable to a door frame or a door. A spring in the cylinder urges the piston to return to a maximum retracted position in the cylinder. As the door is opened, the rod is forced out of the cylindrical tube, compressing the spring. When the door is released, the spring causes the piston to return to its retracted position in the cylindrical tube, thereby closing the door. The controlled movement of the piston within the cylinder determines the rate at which the door is closed. However, hydraulic piston/cylinder type door closers are known to provide inconsistent operation as a function of weather because the consistency of the hydraulic fluid can change with temperature. Moreover, the coil spring used in such door closers to return the piston to its stationary position, are known to deteriorate in time and to break or otherwise fail following exposure to cold temperatures or excessive forces.

Moreover, both pneumatic and hydraulic type door closers are subject to leakage. The piston rod must project from the cylinder at one end for attachment to the door or door frame. The sealing between the cylinder and the rod wears in time and the sealing can also deteriorate as the result of exposure to extremes of heat in the summer and cold in the winter. To minimize loss of fluid due to leakage, the components that form the closed housing for the door closer generally are welded. However, in addition to increasing manufacturing costs, welding produces distortion of the housing and/or internal components. In addition, providing the necessary good sealing requires close tolerances for the piston, the cylinder and the sealing ring which are used in such door closers.

Many door closers include a mechanism for temporarily holding a door in an open position. Usually a manually operated latch, such as a cantable washer is mounted on the exposed part of the rod to allow a user to arrest the door temporarily in an open position. Such a latch is not very convenient to use. Its operation normally requires two hands, one being used to open and hold the door while the other is used to slide the washer on the rod until it contacts a stop provided on the cylinder. Upon release of the door, the stop cants the washer so that the washer traps and arrests the rod so that the door is held open. To unlatch the door, the user must open the door further to relieve the force on the washer applied by the stop and then slide the washer along the rod to a location where it will not contact the stop for the entire retraction movement of the rod into the cylinder as the door closes. In other arrangements, to unlatch the door, the user must turn, push or pull a button or lever to release the latching mechanism. This can be inconvenient if the person is carrying parcels or groceries, for example.

There are many other applications which require mechanisms for raising, lowering covers or lids, or for automatically opening doors or windows or other type of movable closure upon release of a latching mechanism. When released, the mechanism drives the movable closure to its open condition. Typically, these mechanisms include hinge type mechanisms, or springs, for example. In many cases, no automatic opening mechanism or "hold open" mechanism is provided so that the user is at the mercy of the door, lid, or closure.

SUMMARY OF THE INVENTION

The present invention provides a magnetically operated positioning apparatus. The apparatus includes an elongated housing having first and second ends. A shaft, extending within the housing, is adapted for axial movement relative to the housing between retracted and extended positions. A magnet system is coupled to the shaft for moving the shaft from one of the positions to the other one of the positions. The magnet system includes a plurality of positioning permanent magnets located within the housing and extending in an aligned relationship coaxially with the shaft. Each of the permanent magnets has first and second poles of opposite polarities, and the permanent magnets are arranged in a repelling configuration with adjacent ones of the permanent magnets having their poles of common polarity located adjacent to one another. Consequently, repulsion forces produced by adjacent ones of the permanent magnets repel the permanent magnets away from one another, moving the shaft from the one to the other position. The shaft is movable from the other position to the one position, moving the permanent magnets towards one another against the repulsive forces produced by the permanent magnets.

Further in accordance with the invention, there is provided an apparatus for moving a movable member relative to an opening between closed and open positions. The apparatus includes a housing and shaft extending within the housing and being adapted for axial movement relative to the housing between retracted and extended positions. The shaft has a first end and a second end adapted to be coupled to the movable member such that the shaft is moved by the movable member as the movable member is moved between the closed and open positions. A magnet system is coupled to the shaft for moving the shaft between the retracted and extended positions. The magnet system includes a plurality of magnets located within the housing and extending in a coaxially aligned relationship with one another. The magnets are arranged in a repelling configuration for producing magnetic repulsion forces. The strength of the repulsion forces is a function of the spacing between adjacent ones of the magnets. The shaft is movable from one of the positions to the other one of the positions for decreasing the spacing between adjacent magnets to thereby increase repulsive forces produced by the magnets. Consequently, movement of the movable member from one of the positions toward the other one of the positions moves the shaft in a first direction to one of the extended and retracted positions, decreasing the spacing between adjacent magnets, thereby increasing magnetic repulsion forces produced by the magnets. Upon release of the movable member, the magnets are moved apart by the magnetic repulsion forces, moving the shaft in a second direction that is opposite to the first direction to the other one of the retracted and extended positions, thereby moving the movable member to the other position.

Further in accordance with the invention, there is provided a door closer adapted to be coupled between a door and a door frame for providing controlled closing of the door. The door closer comprises a tubular housing having first and second ends, with the housing being coupled to one of the door and the door frame. A shaft, which extends within the housing, is adapted for axial movement relative to the housing. One end of the shaft projects from the housing at the second end thereof and is adapted to be coupled to the other one of door frame and the door. A magnet system is coupled to the shaft and includes a plurality of permanent magnets located within the housing and extending in a coaxially aligned relationship with one another. The permanent magnets are arranged in a repelling configuration for producing magnetic repulsion forces. The strength of the repulsion forces is a function of the relative spacing between adjacent ones of the permanent magnets, whereby as the door is moved from the closed position to the open position, the shaft is moved axially of the housing from the retracted position toward the extended position, decreasing the spacing between adjacent ones of the permanent magnets, thereby increasing the repulsive forces produced by the permanent magnets. When the door is released from an open position to which it has been moved, repulsive forces of the permanent magnets cause the shaft to be moved from the extended position toward the retracted position to close the door.

The invention further provides an apparatus for controlling the movement of a closing member relative to an opening that is adapted to be closed by the closing member. The apparatus comprises a generally tubular housing having first and second ends. A shaft extends within the housing and is movable relative to the housing between retracted and extended positions. One end of the shaft projects from the housing and is adapted to be coupled to the closing member. A magnet system is coupled to the shaft for moving the shaft from the retracted position toward the extended position. The magnet system includes a plurality of permanent magnets, the permanent magnets being arranged in a repelling configuration for producing magnetic repulsion forces, the strength of the repulsion forces being a function of the relative spacing between adjacent one of the permanent magnets. Consequently, as the closing member is moved from the open position toward the closed position, the shaft is moved axially of the housing from the extended position toward the retracted position, decreasing the spacing between adjacent ones of the permanent magnets, thereby increasing repulsive forces produced by the permanent magnets. When the closing member is released from its closed position, repulsive forces produced by the permanent magnets cause the shaft to be moved from the retracted position toward the extended position, moving the closing member toward the open position.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DETAILED DESCRIPTION OF THE PREFERRED EMBODIMENTS

With reference to the drawings, the present invention provides a control mechanism for controlling relative movement between a movable closing member and a support. For purposes of illustration, the control mechanism of the invention is described with reference to an application as a door closer for interior or exterior doors, such as storm doors, screen doors or sliding doors for houses, buildings or other structures. However, the control mechanism can be used in a wide variety of applications, including opening doors of buildings, houses, or other structures, closing and/or opening doors, windows, hatchbacks and/or storage compartments of vehicles, closing and/or opening windows, window shutters, or window blinds, gates, etc., of buildings, houses or other structures, and/or doors, lids or covers of storage chests, cabinets and the like.

Figure 1:
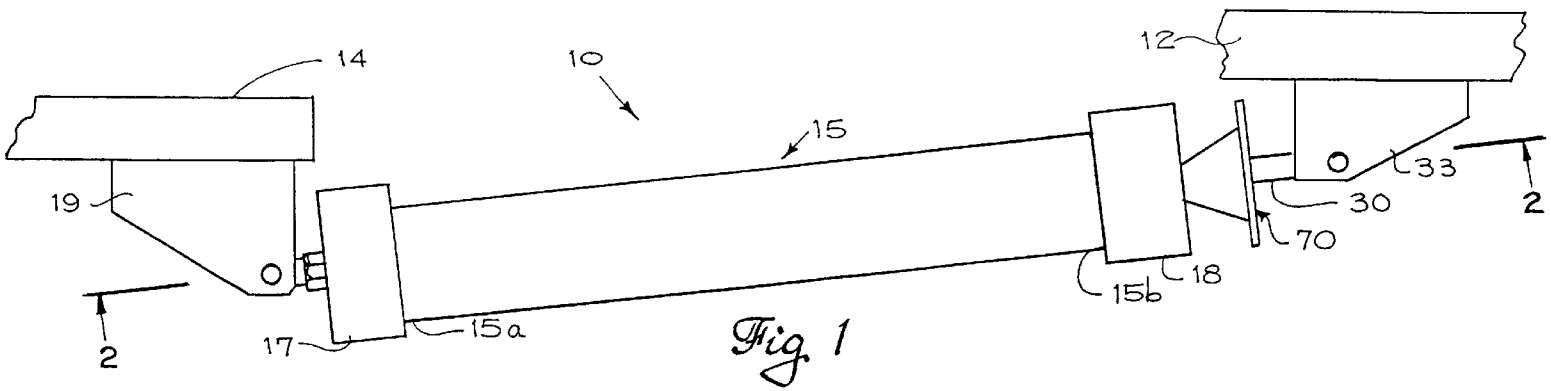
FIG. 1 is a top plan view of a door closer incorporating a control mechanism in accordance with the invention, the door closer being shown mounted between a door and a door frame.
Figure 2:
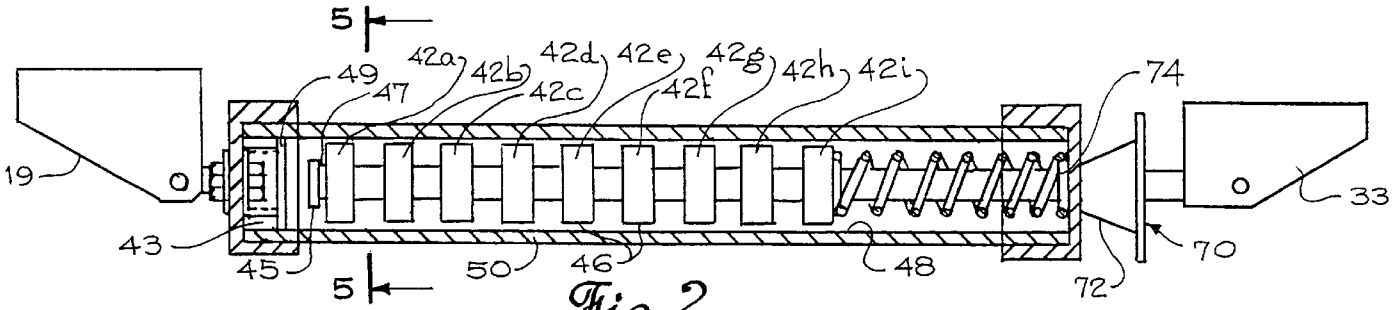
FIG. 2 is a transverse section view of the door closer taken along the line 2—2 of FIG. 1, and showing the door closer in its unoperated or door closing condition.
Figure 3:
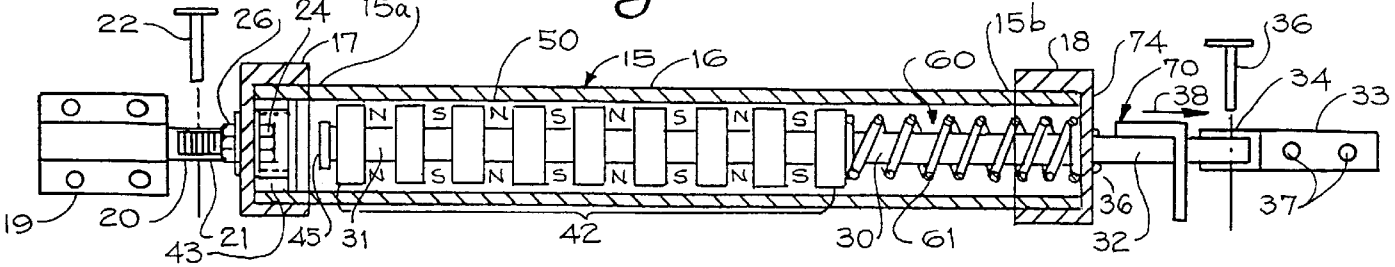
FIG. 3 is a vertical section view of a front view (not illustrated) of the door closer of FIGS. 1 and 2.
Figure 4:
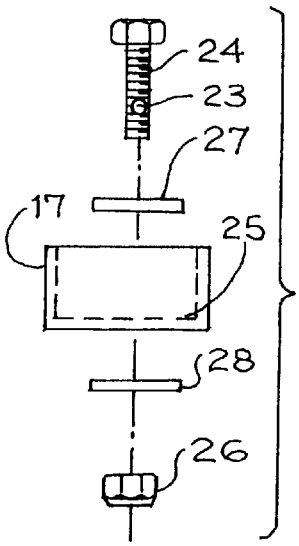
FIG. 4 is an exploded view of an end cap subassembly of the door closer of FIG. 1.

Referring to FIGS. 1–3 of the drawings, the control mechanism 10 provided by the invention is described with reference to an application as a door closer, and thus, is shown coupled between a door 12 and a door frame 14. The door closer 10 includes a tubular housing 15 including a generally cylindrical body 16 which is closed at one end 15*a* by an end cap 17 and closed at the opposite end 15*b* by a further end cap 18. One end 15*a* of the housing is coupled to the door frame 14 in a suitable manner. In one embodiment, end 15*a* of the housing is coupled to the door frame by a mounting bracket 19. The mounting bracket 19 has a clevis 20 with holes 21 for receiving a pin 22 which passes through an aperture 23 (FIG. 4) in the end of a mounting bolt 24 secured to end cap 17. Referring also to FIG. 4, the shank of the bolt 24 extends through an aperture 25 in the end cap 18 and is secured to the end cap 18 by a lock nut 26. A flat washer 27 can be mounted on the bolt 24 between the bolt head and the end wall of the end cap 18. A further flat washer 28 can be mounted on the bolt between the lock nut 26 and the end wall of the end cap 18. In one preferred embodiment, the housing 15 is made of polyvinyl chloride (CPVC) material. However, the housing can be made of aluminum, brass or any other non-magnetic material.

The control mechanism includes a push rod or shaft 30 which extends within the housing 15. The shaft 30 has a first end 31 disposed within the housing and a second end 32 projecting from the housing 15 at its free end 15*b* and coupled to the door 12 in a suitable manner. In one embodiment, the end 32 of the shaft is coupled to the door 12 by a mounting bracket 33. The free end 32 of the shaft 30 has an aperture 34 therethrough to facilitate connection of the end of the shaft to the mounting bracket 33 by a pin 36. The mounting bracket includes suitable mounting holes 37 for securing the mounting bracket to the door. The shaft 30 can be made of aluminum, brass, fiberglass, or other any other non-magnetic material. In one embodiment, the shaft 30 is made of aluminum the strength of which is selected as a function of application. The end cap 18 can include a suitable bearing surface, such as an eyelet 36 of a hard material for supporting the shaft 30. The eyelet 36 can be insert molded into the end cap 18 or secured to the end cap in any suitable manner. It is apparent that the mountings of the door closer 10 to the door frame and the door can be reversed with the fixed end 15*a* of the housing 15 being attached to the door 12 and the end 32 of the shaft 30 being attached to the door frame 14.

The shaft 30 is displaceable relative to the housing 15 between a maximum retracted position and a maximum extended position. An arrow 38 (FIG. 3) indicates the direction of movement of the shaft 30 when the door is opened and the shaft 30 is moved to its extended condition. A further arrow 39 (FIG. 10) indicates the direction of movement of the shaft 30 when the door 12 is closed and the shaft is retracted into the housing 15.

Figure 10:
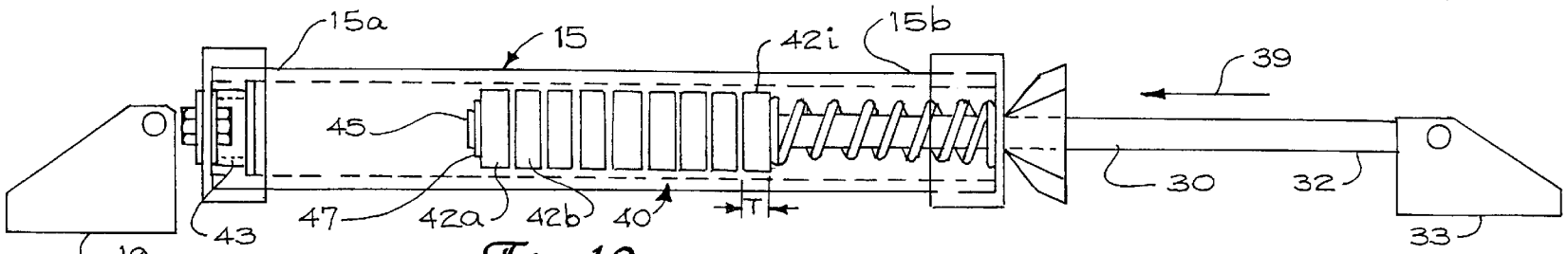
FIG. 10 is a top plan view of the door closer of FIG. 1, partially cut away and with the control mechanism shown in its operated and locked condition.

In accordance with the invention, the door closer 10 includes a magnet system 40 which includes a set of positioning magnets 42 which are carried on the shaft. A further magnet 43 is mounted within the housing 15 for a purpose to be described. Preferably, the magnets 42 and 43 comprise permanent magnets. The permanent magnets 42 are arranged in repulsion configuration so that adjacent ones of the permanent magnets on the shaft repel one another. Briefly, when the door 12 is opened, the shaft 30 is moved from its retracted or stationary position toward its extended position by the door, moving the permanent magnets 42 to decrease the spacing between adjacent ones of the permanent magnets, as illustrated in FIG. 10. This increases the repulsive forces produced by the permanent magnets 42. The magnet system 40 is coupled to the shaft 30 for moving the shaft 30 from the extended position to the retracted position when the door 12 is released from a position to which it has been opened. When the door 12 is released, the repulsion forces produced by the permanent magnets 42 force the permanent magnets apart, causing the shaft 30 to be retracted back into the housing 15, thereby closing the door 12.

Figure 5:
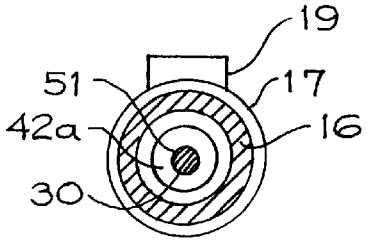
FIG. 5 is a vertical section view of the door closer taken along the line 5—5 of FIG. 2.

More specifically, in one preferred embodiment, the door closer includes nine permanent magnets 42*a*–42*i*. However, more or fewer positioning permanent magnets can be used. The positioning permanent magnets 42 are located within the housing 15 and extend in an aligned relationship coaxially with the shaft 30. At least one of the positioning permanent magnets is mounted on the shaft 30 and movable relative to the shaft, and in one preferred embodiment, all nine positioning permanent magnets 42 are mounted on the shaft 30. In one embodiment, each of the permanent magnets 42, such as permanent magnet 42*a* shown in FIG. 5, is a ring magnet and has a central opening 51 for allowing the permanent magnets to be mounted on the shaft 30. The permanent magnets 42 are not connected to the shaft and are movable axially relative to the shaft 30 as the shaft is moved between its extended and retracted positions.

The inner end 31 of the shaft 30 can be modified or formed in suitable manner to form a projection 45, such as a raised lip, a shoulder, and the like, extending partly or circumferentially around the shaft 30 for maintaining the permanent magnets on the shaft 30. By way of example, the end 31 of the shaft to can be peened to form such projection. A flat washer 47 is mounted on the shaft 30 between the projection 45 and the innermost positioning permanent magnet 42*a*.

Each of the permanent magnets 42 has first and second poles of opposite polarities, labeled in FIG. 3 with the convention N for north pole and S for south pole. The positioning permanent magnets 42 are arranged in a repelling configuration with adjacent ones of the permanent magnets, such as permanent magnets 42*a*, 42*b*; 42*b*, 42*c*; 42*c*, 42*d*; etc., having their poles of common polarity located adjacent to one another. Consequently, repulsion forces produced by adjacent permanent magnets 42 repel the permanent magnets away from one another.

Thus, when the door is released from a position to which it has been opened, the innermost positioning magnet 42*a*, which engages the projection 45 on the shaft 30, drives the shaft 30 inwardly into the housing 15 due to the effects of the repulsion forces produced by the permanent magnets 42, so that the shaft 30 is retracted into the housing 15.

The permanent magnet 43 is an attracting or latching magnet which attracts the positioning permanent magnet 42*a* that is located at the inner end of the shaft. In one embodiment, the permanent magnet 43 is ring magnet and has a central aperture 44 allowing the magnet to be mounted on the head of bolt 24. Preferably, two washers 47 and 49 are interposed between the permanent magnets 43 and 42*a* to prevent damage to the permanent magnets by preventing the permanent magnets from coming into physical contact with one another. As is shown in FIG. 3, the permanent magnet 43 is oriented to have its north pole N opposing the south pole S of the positioning permanent magnet 42*a*. The permanent magnet 43 attracts and latches the permanent magnet 42*a* as the shaft 30 is being moved to its retracted position.

The permanent magnets 42 are adapted for sliding movement along an inner surface 48 of the housing 15 as the shaft 30 is moved between retracted and extended positions. The permanent magnets 42 have peripheral edges 46 (FIG. 2) which are adapted for sliding movement along an inner surface 48 of the housing, and including a suitable lubricant 50, such as light grease, and more preferably a dry lubricant such as graphite of silicone lubricant, disposed on the inner surface 48 of the housing 16.

In one embodiment, the permanent magnets 42 and 43 are rare earth magnets, such as neodymium iron boron (NdFeB) or samarium cobalt (SmCo) magnets. Such magnets exhibit high energy and coercive forces. In addition, the magnets can be plated with nickel or zinc to protect the magnets against corrosion and to further enhance their durability. Of course rather than using a neodymium iron boron alloy magnet, a high neodymium content material can be used. However, alloys having very high neodymium content, which have excellent magnetic property, are more expensive that neodymium iron alloys is believed that magnet operating at an energy product of at least 10 and up to 35 mega-gauss-0ersteds is sufficient to practice the invention. The magnets are magnetized through their thickness T (FIG. 10).

Figure 6:
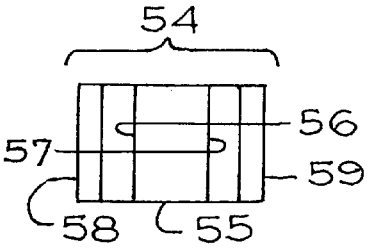
FIG. 6 is a side view of a further embodiment for a permanent magnet for the door closer of FIG. 1.

Referring to FIG. 6, at least one of the positioning permanent magnets 42, and preferably all of the positioning permanent magnets 42 can comprise a composite permanent magnet structure, such as structure 54 shown in FIG. 6. The composite magnet includes a ceramic core 55 having a first side 56 and a second side 57, with first and second rare earth magnets 58 and 59 located at the first and second sides 56 and 57, respectively, of the ceramic core 55. In one embodiment, the ceramic core 55 is a grade 5 ceramic ring magnet commercially available as part number CR74RMX from Master Magnetics, Inc. of Castle Rock Colo. The rare earth magnets 58 and 59 are grade 30, neodymium ring magnets commercially available as part number NR 74IN-30 from Master Magnetics, Inc.

Preferably, the door closer 10 includes a backlash damper mechanism 60 for preventing damage to the door 12 in the event of excessive forces which can be caused, for example, by strong winds. In one embodiment, the backlash damper mechanism 60 includes a compression spring 61 located within the housing 15 near end 15*b* and encircling the shaft 30 near end 32 thereof. The spring 61 is interposed between the outermost positioning permanent magnet 42*i* and an inner end surface 62 of the housing 15. In one embodiment, the backlash damper spring is the Servolite Corp. spring, catalog item #196, and cut in half.

The spring 61 is compressed slightly as the door approaches its full open position (FIG. 10), providing damping for absorbing overload forces applied to the door closer. Preferably, the spring 61 is provided only for absorbing excessive forces and does not operate to return the shaft 30 to its retracted or stationary position. This function is provided by the positioning permanent magnets 42. Thus, in contrast to conventional pneumatic or hydraulic piston/cylinder apparatus in which a spring moves the shaft from the extended position back to the retracted position within the cylinder, the shaft 30 of the control mechanism 10 is moved solely by the repelling forces of the permanent magnets 42 at least over a portion of its travel, and independent of the forces produced by the spring 61. That is, as the shaft 30 is extended as the result of opening the door 12, initially, the spring is not compressed. Upon release of the door from a position to which it has been opened, while initially movement may be due in part to the spring 61, the end portion of the travel of the shaft is provided by positioning permanent magnets 42.

Figure 7:
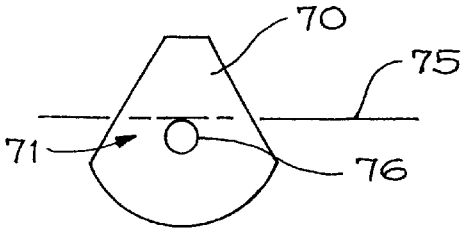
FIG. 7 is a plan view of a lock element of the door closer prior to being bent into its final shape.
Figure 8:
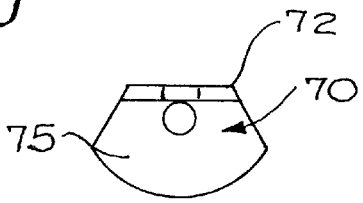
FIG. 8 is a plan view of the lock element after it has been bent to its final shape.
Figure 9:
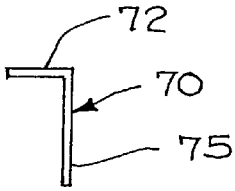
FIG. 9 is a side view of the lock element of FIG. 8.

Refer also to FIGS. 7–9, in accordance with a feature of the invention, the door closer can include a locking element or mechanism 70 embodied as a cantable washer 71. The washer 71 has an engaging portion 72 and a portion 73 of increased mass. The washer 71 is slidably mounted on the shaft 30 adjacent to the end 15*b* of the housing 15 with the engaging portion extending generally horizontally above the shaft and the portion 73 extending generally vertically below the shaft. End cap 18 defines a contact surface for the housing. The washer 71 is formed from a fender washer to have the shape shown in FIG. 7 and then is bent along a line 75 that extends just above hole 76.

After opening the door, the washer 71 can be canted manually whereby of the engaging portion 72 of the washer 71 engages the contact surface 74 of the housing to arrest the shaft 30 from further retraction into the housing as illustrated in FIG. 10, for maintaining the door in an open position to which it has been moved. However, in response to movement of the contact surface 74 out of engagement with the engaging portion 72 of the washer 71, such as by opening the door further, the portion 73 of increased mass, extending below the shaft acting as a pendulum weight, causes the washer 71 to be automatically moved from a canted position to a substantially vertical or upright position, releasing the door for closing.

Referring to FIGS. 1–4, to assemble the door closer 10 in accordance with one embodiment, the end cap 18 is applied to end 15*b* of the cylinder 16 and secured to the cylinder in a suitable manner, such as with glue. One glue suitable for use with a housing made of PVC material is polyvinyl chloride (PCV) glue. The washer 47 is mounted on the shaft 30 engaging the peened end 45 of the shaft. The permanent magnets 42 are mounted on the shaft. Then, the compression spring 61 is positioned on the shaft. The subassembly of the shaft 30, the permanent magnets 42 and the compression spring 61, is inserted into the cylinder 16 through its open end 15*a* and end 32 of the shaft 30 is passed through the eyelet 36 to project from the housing at its end 15*b*. The washer 71 is applied to the shaft 30 and the end 32 of the shaft is crimped to form a flattened mounting surface in which aperture 34 is then formed. The washer 49 is press fit into the open end of the cylinder 16 and the attracting permanent magnet 43 is positioned on the washer 49. Then, the other end cap 17, preassembled with the bolt 24, the washers 27 and 28 and the lock nut 26, is mounted on the open end 15*a* of the housing and secured in place by PVC glue.

With reference to FIGS. 1–3, by way of illustration of the operation of the door closer 10, it is assumed initially that the door 12 is closed, and the door closer 10 is at its retracted or stationary position as shown in FIG. 3, for example. As the door is moved from the closed position to the open position, the shaft is moved axially of the housing from the retracted position toward the extended position. As is stated above, initially, there is substantially no compression of the damping spring 61 as the shaft is drawn out of the housing. As the shaft is being drawn from the housing to its extended position, the permanent magnets 42 are moved axially along the shaft and are moved closer together. Consequently, the spacing between adjacent ones of the magnets is decreased, thereby increasing the effective repulsive forces produced by the magnets. The permanent magnets 42 become closely spaced when the door reaches its full open position, as shown in FIG. 10. In one embodiment in which the shaft 30 is about fourteen inches in length, the length of travel of the shaft 30 is on the order of about one and one-half to two inches. In contrast, the length of travel of the piston rod of conventional hydraulic or pneumatic type door closers is about five to six inches. In addition, these conventional door closers rely on a spring to return the piston to its at rest position, with the hydraulic (or pneumatic) mechanism providing a damping effect to provide controlled closing of the door.

When the door has been opened, the lock element 71 can be manually slid along the shaft 30 and canted such that the engaging portion 72 of the lock element 71 engages the contact surface 74 of the housing 15 so that the door is held in the position to which it has been opened. The door can be released by opening the door 12 further to move the contact surface 74 out of engagement with the engaging portion 72, allowing the increased mass portion 73 of the lock element 71 to pivot the lock element to a generally upright or vertical orientation, allowing the door to be closed by the door closer upon release of the door.

When the door 12 is released from the position to which the door has been opened, the repulsive forces of the positioning permanent magnets 42, working against the projection 45 on the end of the shaft and spring 61 on the one hand, and against the spring 61 which extends between the outermost permanent magnet 42*i* and end cap 18 which is secured to cylinder 16, cause the shaft 30 to be moved from the extended position toward the retracted position to close the door. As the shaft 30 approaches its retracted or stationary position, the attracting or latch permanent magnet 43 attracts at least the permanent magnet 42*a* carried by the inner end of the shaft 30. The permanent magnet 42*a* is drawn toward the attracting magnet 43, forcing the washers 47 and 49 to have physical contact.

In the foregoing description, the control mechanism is a door closer. However, the control mechanism can also be used for opening doors or windows of houses, buildings or other structures or vehicles. In addition, the control mechanism can be used for opening and/or closing covers or lids for containers, such as chests, cargo holders, and the like, or for otherwise moving covers or lids for chests, coolers, cargo holders, toppers, truck boxes, utility boxes or compartments on vehicles.

Figure 12:
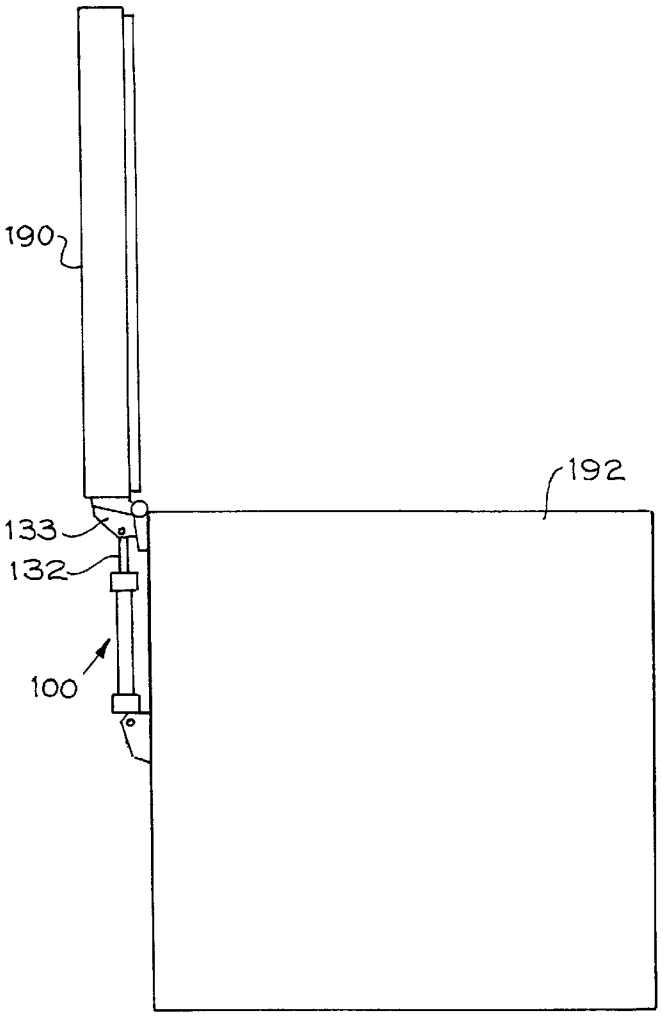
FIG. 12 is a view similar to FIG. 11 and showing the control mechanism in its operated condition.
Figure 11:
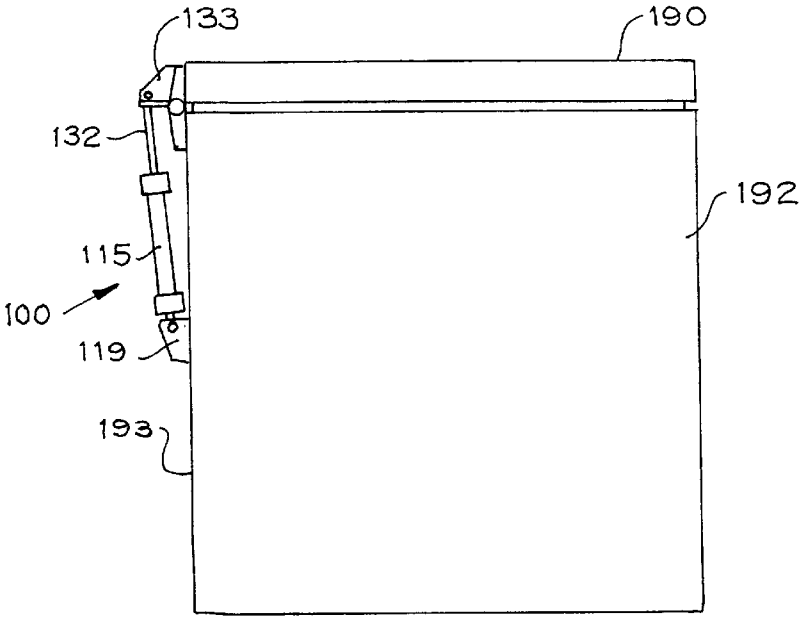
FIG. 11 is a view of a storage container incorporating the control mechanism provided by the invention for opening a cover of the storage container.

Referring now to FIGS. 11 and 12, by way of illustration, the closing or control mechanism 10 is shown in an application for opening a cover or lid 90 of a container 92. The housing 15 of the opening mechanism 10 is secured to the back wall 93 of the container 92 by a mounting bracket 19. The free end 32 of the shaft 30 is coupled to the cover 90 by a mounting bracket 33. It is apparent that the housing 15 can be connected to the cover 90 by mounting bracket 19 and the free end 32 of the shaft 30 can be connected to the container 90 by mounting bracket 33.

The container 92 is shown closed in FIG. 11, and the positioning permanent magnets 42 are drawn together in the manner illustrated in FIG. 10. As the cover 90 is pivoted to the open position illustrated in FIG. 12 under the force of the positioning permanent magnets 42 in the manner described above with reference to door closer 10. When the cover 90 is closed manually, the positioning permanent magnets 42 are moved together, increasing the repulsion force to the level sufficient to open the cover when it is subsequently unlatched.

As the cover 90 is moved from the open position to the closed position, the shaft 30 is moved axially of the housing 15 from its extended position toward its retracted position. Consequently, the spacing between adjacent ones of the positioning permanent magnets 42 is decreased, thereby increasing repulsive forces produced by the positioning permanent magnets 42. When the cover is released, the repulsive forces of the permanent magnets 42 cause the shaft to be moved from the retracted position toward the extended position, moving the cover toward the open position.

The repulsion permanent magnet 43 which is coupled to the inner surface of the end cap 17 effectively functions as a reaction surface for forcing the string of positioning permanents 42 in a direction away from the end cap 17 because the repulsion permanent magnet 43 is oriented in opposing relation with the innermost positioning permanent magnet 42*a*.

Figure 13:
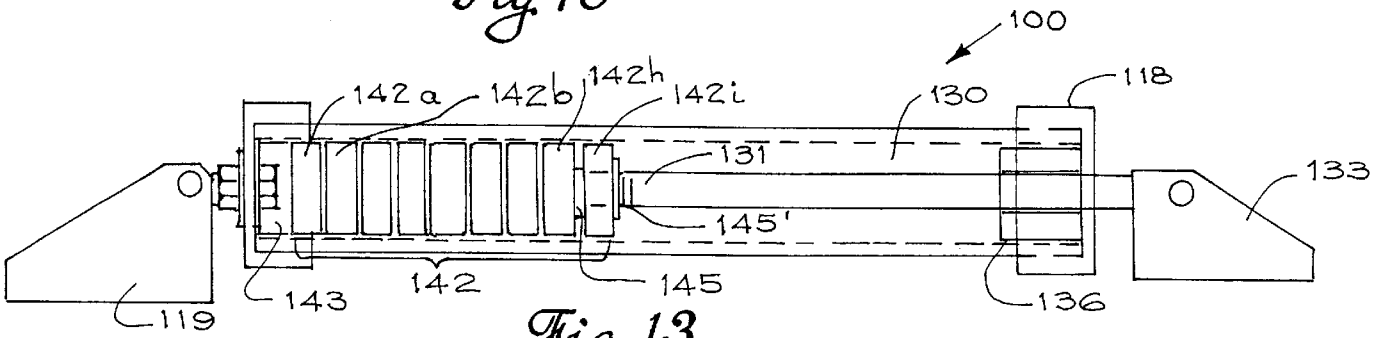
FIG. 13 is a view of a further embodiment of a control mechanism provided by the invention which is adapted for use as an opening apparatus and with the control mechanism shown in its retracted condition.
Figure 14:
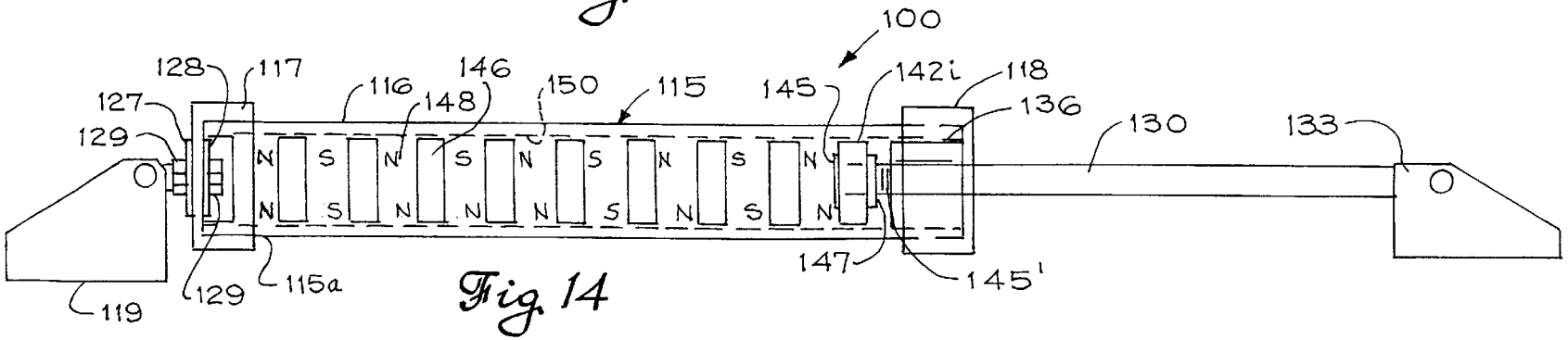
FIG. 14 is a view similar to FIG. 13 and showing the control mechanism in its extended condition.

Referring to FIGS. 13 and 14, there is shown a control mechanism 100 in accordance with a further embodiment of the invention for operating as an opening mechanism. The control or opening mechanism 100 is generally similar to the door closer 10 and accordingly, elements of opening mechanism 100 have been given the same reference numerals, but preceded by a "1", as corresponding elements of door closer 10 illustrated in FIGS. 1–10. The positioning permanent magnets 142 of opening mechanism 100 are disc magnets (without a central aperture) and one or more of the positioning permanent magnets 142*a*–142*i* is adapted to "float" within the housing rather than being carried on the shaft 130. In addition, the permanent magnet 143 is oriented for repelling rather than attracting as in the manner of attracting permanent magnet 43. The repelling permanent magnet 143 can be mounted in the housing 115 near end 115*a* thereof, in the manner of attracting permanent magnet 43 (FIGS. 2 and 10) as described above. However, there is no washer interposed between the permanent magnet 143 and the positioning permanent magnets 142.

In one embodiment, the permanent magnets 142 and 143 are rare earth magnets, such as neodymium iron boron (NdFeB) or samarium cobalt (SmCo) magnets, or a high neodymium content material, as described above. In addition, the magnets can be plated with nickel or zinc to protect the magnets against corrosion and to further enhance their durability. Moreover, at least one of the positioning permanent magnets 142, and preferably all of the positioning permanent magnets 142 can comprise a composite permanent magnet structure, such as structure 54 shown in FIG. 6.

In one preferred embodiment, at least one of the permanent magnets 142*i* is mechanically coupled to the shaft 130 as shown in FIG. 14 which illustrates the opening mechanism 100 in the operated or extended condition. The permanent magnet 142*i* can be generally circular in shape and has a central aperture. The permanent magnet 142*i* is mounted on the shaft 130 near the first end of the shaft In one embodiment, the inner end 131 of the shaft 132 defines a projection 145, providing as lip or shoulder at one side of the permanent magnet 142*i*. A further projection 145' is provided on the shaft 130 at the opposite side of the permanent magnet, for securing the permanent magnet 142*i* to the shaft. The projection 145 can be formed on the end 131 of the shaft 130 in any suitable manner and in one embodiment, the end 131 of the shaft is peened to define the projection 145. The projection 145' can be formed in any suitable way and in one embodiment, is formed by crimping the shaft. Alternatively, separate elements can be clamped on otherwise secured to the shaft 130 on opposite sides of the permanent magnet 142*i* to retain the permanent magnet on the shaft. A washer 147 can be interposed between the permanent magnet 142*i* and the projection 145'. The permanent magnet 142*i* is trapped between the two projections 145 and 145' and thus is moved with the shaft 130 as the shaft is moved between its retracted and extended positions.

The positioning permanent magnets 142 have peripheral edges 146 which are adapted for sliding movement along an interior surface 148 of the housing as the shaft is moved between extended and retracted positions. The positioning permanent magnets 142 are guided within the housing 115 by the substantially cylindrical inner surface 148 of the housing 115. Preferably the inner surface of the housing is coated with a suitable lubricant 150, such as a light grease, and preferably a dry lubricant such as graphite or silicone. The positioning permanent magnets 142*a*–142*h* are interposed between the repelling permanent magnet 143 mounted near end 115*a* of the housing and the positioning permanent magnet 142*i* mounted on the shaft 130 near its end 131.

In accordance with one embodiment, in assembling the opening mechanism 100, the end cap 117 is preassembled with the bolt 124, the washers 127 and 128 the lock nut 126. The repelling permanent magnet 143 is positioned in the end cap 117 over the head of the bolt 124. The subassembly including the end cap 117, the permanent magnet 143, the bolt 124 and lock nut 126, is positioned over the end 115*a* of the cylinder 116 and secured to the cylinder 116 in any suitable manner. For example, the end cap 117 can be secured to the cylinder with PVC glue when the cylinder 116 and end cap 118 comprise PVC material. Then, the positioning permanent magnets 142*a*–142*h* are inserted into the cylinder 116 through its open end 115*b*. The subassembly of the shaft and the permanent magnet 142*i* is inserted through the opening in the end cap 118 and this assembly is then inserted into the cylinder 116 through its open end 115*b*. The end cap 118 is and secured to the cylinder 116 in any suitable manner such as with PVC glue when the cylinder 116 and end cap 118 are of PVC material. A stop cylinder 136 is applied between the end 115 and magnets 142 prior to mounting of end cap 118 on the cylinder 116. The stop cylinder prevents the shaft from tilting relative to the housing when the shaft is at or near its fully extended position.

FIG. 13 illustrates the closed or unoperated condition for the opening mechanism 100. For this condition, the permanent magnets 142 are closely spaced and the repelling forces at maximum so that the permanent magnets are disposed to be moved axially with respect to the housing by the repulsion forces, to force the shaft 130 out of the housing. FIG. 14 illustrates the opening mechanism 100 in its operated or extended condition. In the operated condition, the positioning permanent magnets 142 have been moved apart to be axially separated from one another to a stationary position for the shaft 130. In either condition, at least the innermost permanent magnet 142*a* works against the repelling permanent magnet 143 which is secured to the end cap 117 which is fixed to the cylinder 116.

Figure 15:
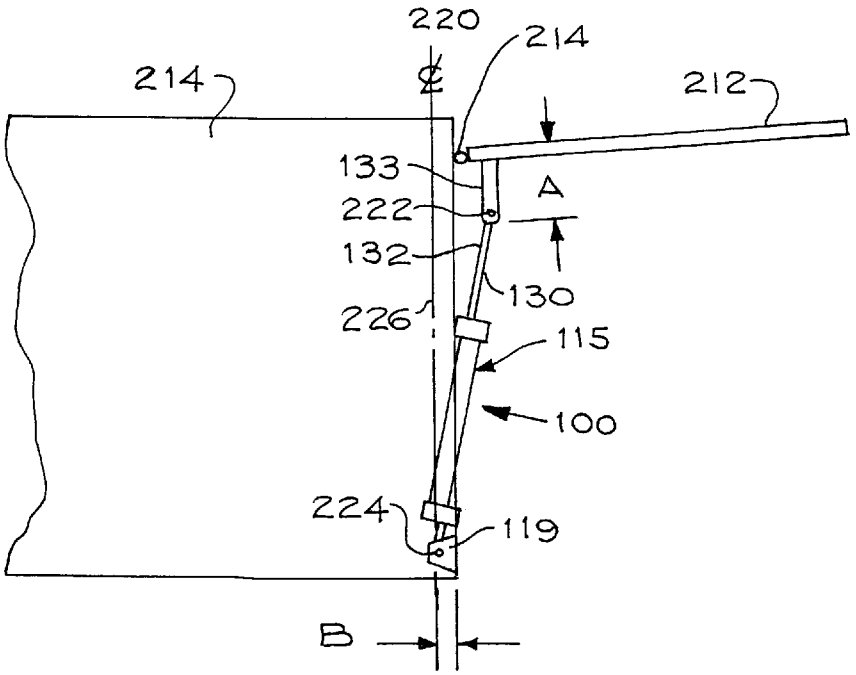
FIG. 15 is a side view of a container incorporating the control mechanism of FIGS. 13 and 14, and with the control mechanism shown in its extended condition, acting as an opener.

Referring now to FIG. 15, there is shown a simplified representation of the opening mechanism 100 shown in FIG. 13 in an application in which the control or opening mechanism 100 is coupled between a lid or cover 212 of a container 214 for opening a lid or cover 212 of the container. In this embodiment, the opening mechanism also assists in closing the lid or cover 212, which can be a side opening lid or cover. The container 214 can be any type of container, such as a cooler, a freezer, and the like.

Figure 16:
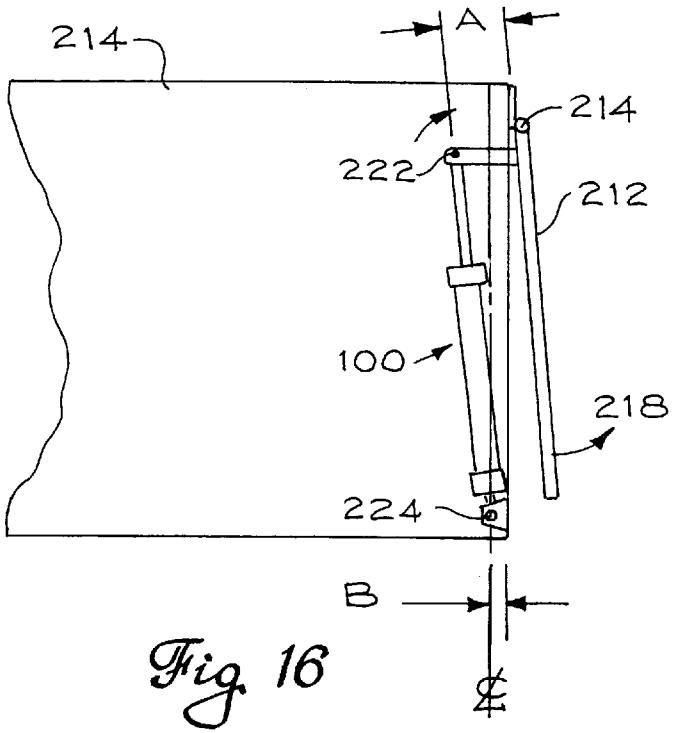
FIG. 16 is a view similar to that of FIG. 15 and showing the control mechanism in its partially extended, operating as a closer.

With reference to FIG. 15, the housing 115 can be coupled to the container 214 by a mounting bracket 119 or any other suitable connection, and the shaft 130 can be coupled to the cover 212 by a mounting bracket 133 or any other suitable connection. In addition, the mounting bracket 119 can be located within the container as illustrated in FIGS. 15 and 16 or mounted on the outside of the container. The cover is pivotably coupled to the container by a pivot 214. In one preferred embodiment, the length of the mounting bracket 133 is selected so that the point of attachment or pivot point 222 for the end 132 of the shaft 130 is spaced from the cover by a distance "A". The length of the mounting bracket 119 is selected so that the point of attachment or pivot point 224 of the end of the housing 115 lines on a vertical plane represented by centerline 226, which is spaced from the edge 216 of the container 214 cover by a distance "B", where the distance "A" is greater than the distance "B".

To describe the operation of the opening mechanism 100 in this embodiment, it is assumed initially that the cover 212 is closed and that the positioning permanent magnets 142 are held in closely spaced relationship in the manner illustrated in FIG. 11. To obtain access to the container, the cover 212 is opened manually by pulling the lower end of the cover in the direction of the arrow 218, pivoting the cover 212 about its pivot 214. When the cover 212 is released, the repelling forces produced by adjacent permanent magnets 142 cause the shaft 130 to be extended, thereby continuing pivoting of the cover 212 about its pivot 214 to its fully open position illustrated in FIG. 15. The cover 212 is maintained in its open position by the repelling forces produced by the permanent magnets 142. To close the cover 212, the cover is pivoted downward, manually to the closed position.

In accordance with a feature of the invention, the opening mechanism 100 also acts as a closer and assists in closing the cover as the cover is being closed manually. As the cover is being closed, the opening mechanism 100 pivots about the pivot point 224 for the housing. Eventually the pivot point 224 for the shaft 130 reaches or becomes aligned with the centerline 226 which corresponds to the maximum retraction of the shaft 130 within the housing. Referring to FIG. 16, with continued pivoting of the cover past this point, the opening mechanism operates to cause the shaft 130 to be partially extended due to the action of the positioning permanent magnets 142, causing the pivoting the mounting bracket 133 in the direction of arrow 230, acting as a closer for drawing the cover 212 tightly against the open end of the container 214.

While particular embodiments of the invention have been shown and described, it will be obvious to those skilled in the art that changes and modifications may be made without departing from the invention in its broader aspects. For example, the apparatus can also be used for repositioning movable shelves, for operating recliner chairs or as a scale. In such applications, the movable member can be moved in vertical or horizontal directions, with a pivoting or sliding movement as a function of application. Also, the apparatus can be used to deploy pop-up campers or open foldable tables and chairs, bleachers, and the like. The apparatus can also be used to position cash register drawers, movable shelves, or operate pop-up toaster or as a shoe stretcher or handle for an upright vacuum cleaner. It is apparent that the physical size of the permanent magnets and the strength of the permanent magnets on the Gauss scale are determined by each individual application. Therefore, the aim in the appended claims is to cover all such changes and modifications as fall within the true spirit and scope of the invention.

What is claimed is:

1. A magnetically operated positioning apparatus comprising:

a housing having first and second ends;

a shaft including a shaft portion extending within the housing, the shaft being adapted for axial movement relative to the housing between retracted and extended positions; and a magnet system coupled to the shaft for moving the shaft from one of said positions to the other one of said positions, the magnet system including a plurality of positioning permanent magnets located within the housing and extending in an aligned relationship coaxially with the shaft, each of the permanent magnets having first and second poles of opposite polarities, the permanent magnets being arranged in a repelling configuration with adjacent ones of the permanent magnets having their poles of common polarity located adjacent to one another, whereby repulsion forces produced by adjacent ones of the permanent magnets repel the permanent magnets away from one another, moving the shaft from said one position to said other position, the shaft being movable manually away from said other position, moving the permanent magnets towards one another against the repulsive forces produced by the permanent magnets.

2. The apparatus as claimed in claim 1, wherein a first end of the shaft is located near the first end of the housing when the shaft is in the retracted position, at least one of the positioning permanent magnets being configured and arranged to engage the shaft near the first end of the shaft at least as the shaft is moved from the extended position to the retracted position, and wherein the magnet system further includes an attracting permanent magnet disposed within the housing near the first end of the housing, the attracting permanent magnet having first and second poles of opposite polarities and being disposed in attracting relationship with said one positioning permanent magnet for moving at least said one positioning permanent magnet, and thus the shaft, towards the first end of the housing.

3. The apparatus as claimed in claim 1, wherein the positioning permanent magnets are movably mounted on the shaft for movement relative to the shaft as the shaft moves between said retracted and extended positions.

4. The apparatus as claimed in claim 1, wherein at least a first one of the positioning permanent magnets is mounted on the shaft, said first positioning permanent magnet being carried by the shaft as the shaft moves between said retracted and extended positions.

5. The apparatus as claimed in claim 4, wherein at least a second one of said positioning permanent magnets is interposed between the first end of the shaft and the first end of the housing and is adapted to move relative to the first end of the housing, guided by an inner surface of the housing, as the shaft moves between said retracted and extended positions.

6. The apparatus as claimed in claim 4, wherein the magnet system includes a repelling permanent magnet secured to the housing near the first end of the housing, the repelling permanent magnet having first and second poles of opposite polarities and being disposed in repelling relationship with at least one of the positioning permanent magnets.

7. The apparatus as claimed in claim 1, wherein the permanent magnets comprise a rare earth material.

8. Apparatus for moving a movable member relative to an opening between closed and open positions, said apparatus comprising:

a housing having first and second ends;

a shaft including a shaft portion extending within the housing, the shaft being adapted for axial movement relative to the housing between retracted and extended positions, the shaft having a first end and a second end adapted to be coupled to the movable member such that the shaft is moved by the movable member as the movable member is moved between the closed and open positions; and a magnet system coupled to the shaft for moving the shaft between said retracted and extended positions, the magnet system including a plurality of magnets located within the housing and extending in a coaxially aligned relationship with one another, the magnets being arranged in a repelling configuration for producing magnetic repulsion forces, the strength of the repulsion forces being a function of the spacing between adjacent ones of the magnets;

the shaft being movable from one of said positions toward the other one of said positions for decreasing the spacing between adjacent magnets to thereby increase repulsive forces produced by the magnets, whereby movement of the movable member from one of said positions toward the other one of said positions moves the shaft in a first direction to one of said extended and retracted positions, decreasing the spacing between adjacent magnets, thereby increasing magnetic repulsion forces produced by the magnets, and upon release of the movable member, the magnets are moved apart by the magnetic repulsion forces, moving the shaft in a second direction that is opposite to the first direction, thereby moving the movable member to said one position.

9. The apparatus as claimed in claim 8, wherein the movable member is a door and the opening is a doorway, and wherein, as the door is moved from the closed position to the open position, the shaft is moved axially of the housing from the retracted position toward the extended position, decreasing the spacing between adjacent ones of the magnets, thereby increasing the effective repulsive forces produced by the magnets, and when the door is released from a position to which the door has been opened, the repulsive forces of the magnets cause the shaft to be moved from the extended position toward the retracted position to close the door.

10. The apparatus as claimed in claim 8, wherein the movable member is a closing member which is adapted to be moved between open and closed positions, and wherein, as the closing member is moved from the open position to the closed position, the shaft is moved axially of the housing from the extended position toward the retracted position, decreasing the spacing between adjacent ones of the magnets, thereby increasing repulsive forces produced by the magnets, and when the closing member is released, the repulsive forces of the magnets cause the shaft to be moved from the retracted position toward the extended position, moving the closing member toward the open position.

11. The apparatus as claimed in claim 8, wherein at least one of the magnets is a disk magnet interposed between the first end of the housing and the first end of the shaft.

12. The apparatus as claimed in claim 11, wherein at least one of the magnets is a ring magnet and has a central aperture, said ring magnet being mounted on the shaft near the first end of the shaft and being moved with the shaft as the shaft moves between the retracted and extended positions.

13. The apparatus as claimed in claim 8, wherein the magnets are adapted for sliding movement along an inner surface of the housing as the shaft is moved between retracted and extended positions.

14. The apparatus as claimed in claim 8, wherein the magnets are generally circular in shape and have a central opening for allowing the magnets to be mounted on the shaft, the magnets being movable axially relative to the shaft as the shaft moves between said extended and retracted positions.

15. The apparatus as claimed in claim 8, wherein the magnets comprise Permanent magnets.

16. The apparatus as claimed in claim 8, wherein the magnets comprise a rare earth material.

17. The apparatus as claimed in claim 16, wherein the magnets are selected from the group consisting of neodymium iron boron, samarium cobalt, nickel plated neodymium iron boron, zinc plated neodymium iron boron, nickel plated samarium cobalt, and zinc plated samarium cobalt.

18. The apparatus as claimed in claim 8, wherein each of said magnets comprises a composite element including a ceramic core having first and second sides, and first and second rare earth magnets located at the first and second sides, respectively, of the ceramic core.

19. The apparatus as claimed in claim 8 wherein the shaft comprises a non-magnetic material.

20. A door closer adapted to be coupled between a door and a door frame for providing controlled closing of the door, said door closer comprising:

a tubular housing having first and second ends, the housing being adapted to be coupled to the door and the door frame;

a shaft including a shaft portion extending within the housing and being adapted for axial movement relative to the housing between retracted and extended positions, the shaft having a first end and a second end projecting from the housing at the second end thereof and adapted to be coupled to the door frame and the door;

a magnet system coupled to the shaft, the magnet system including a plurality of permanent magnets located within the housing and extending in a coaxially aligned relationship with one another, the permanent magnets being arranged in a repelling configuration for producing magnetic repulsion forces, the strength of the repulsion forces being a function of the relative spacing between adjacent ones of the permanent magnets, whereby as the door is moved from the closed position to the open position, the shaft is moved axially of the housing from the retracted position toward the extended position, decreasing the spacing between adjacent ones of the permanent magnets, thereby increasing the repulsive forces produced by the permanent magnets, and when the door is released from an open position to which it has been moved, repulsive forces of the permanent magnets cause the shaft to be moved from the extended position toward the retracted position to close the door.

21. The door closer as claimed in claim 20, wherein at least one of the permanent magnets is mounted on the shaft, said one permanent magnet being movable relative to the shaft.

22. The door closer as claimed in claim 20, wherein at least one of said plurality of permanent magnets is mounted on the shaft and movable relative to the shaft, and wherein the first end of the shaft is formed to maintain said one permanent magnet on the shaft.

23. The door closer as claimed in claim 20, and including a locking element carried on the shaft and being adapted to be canted whereby an engaging portion of the locking element engages a contact surface of the housing for maintaining the door in an open position to which it has been moved, the locking element including a portion of increased mass which extends below the shaft, whereby the locking element is automatically moved from a canted position to a substantially vertical position in response to movement of the contact surface out of engagement with the engaging portion of the locking element.

24. The door closer as claimed in claim 20, further comprising a backlash damper structure located within the housing, the backlash damper structure being interposed between one of the permanent magnets and an end surface of the housing for absorbing overload forces applied to the door closer.

25. The door closer as claimed in claim 24, wherein the backlash damper structure comprises a compression spring.

26. The door closer as claimed in claim 24, wherein the shaft is moved by the repelling forces of the permanent magnets over at least a portion of its travel and independent of the forces produced by the backlash damper structure.

27. The door closer as claimed in claim 20, wherein the magnet system further comprises an attraction permanent magnet coupled to the first end of the housing and oriented in attracting relation with at least one permanent magnet of the plurality of permanent magnets.

28. The door closer as claimed in claim 20, wherein the permanent magnets have peripheral edges which are adapted for sliding movement along an interior surface of the housing, and including a lubricant disposed on the inner surface of the housing.

29. The door closer as claimed in claim 20, wherein the housing comprises a non-magnetic material.

30. The door closer as claimed in claim 20, wherein at least one of the permanent magnets is secured to the shaft.

31. The door closer as claimed in claim 20, wherein the permanent magnets comprise ring magnets, each having a central opening for allowing the permanent magnets to be mounted on the shaft, the permanent magnets being movable axially relative to the shaft as the shaft moves between said retracted and extended positions.

32. The door closer as claimed in claim 20, wherein at least one of said permanent magnets comprises a composite element including a ceramic core having first and second sides, and first and second rare earth magnets located at the first and second sides, respectively, of the ceramic core.

33. Apparatus for controlling the movement of a closing member relative to an opening that is adapted to be closed by the closing member, the apparatus comprising:

a generally tubular housing having first and second ends;

a shaft including a shaft portion extending within the housing and movable relative to the housing between retracted and extended positions, the shaft having a first end and a second end projecting the housing at the first end thereof, the second end of the shaft being adapted to be coupled to the closing member;

a magnet system coupled to the shaft for moving the shaft from the retracted position toward the extended position, the magnet system including a plurality of permanent magnets, the permanent magnets being arranged in a repelling configuration for producing magnetic repulsion forces, the strength of the repulsion forces being a function of the relative spacing between adjacent one of the permanent magnets, whereby, as the closing member is moved from the open position toward the closed position, the shaft is moved axially of the housing from the extended position toward the retracted position, decreasing the spacing between adjacent ones of the permanent magnets, thereby increasing repulsive forces produced by the permanent magnets, and when the closing member is released from its closed position, repulsive forces produced by the permanent magnets cause the shaft to be moved from the retracted position toward the extended position, moving the closing member toward the open position.

34. The apparatus as claimed in claim 33, wherein at least a first one of the permanent magnets is mounted on the shaft near the first end of the shaft, said first permanent magnet being moved with the shaft as the shaft is moved between the retracted and extended positions.

35. The apparatus as claimed in claim 34, wherein at least a second one of the permanent magnets comprises a disk magnet which is interposed between the first end of housing and the first end of the shaft.

36. The apparatus as claimed in claim 35, wherein at least said second permanent magnet floats within the housing and is guided by a substantially cylindrical inner surface of the housing.

37. The apparatus as claimed in claim 34, including a travel limit structure within the housing, the travel limit structure being located near the second end of the housing, and being engaged by a portion of the shaft near the first end of the shaft as the shaft approaches the extended position.

38. The apparatus as claimed in claim 34, wherein the shaft reaches a fully retracted position prior to the closing member reaching the closed position, and wherein as the shaft reaches the fully retracted position during movement of the shaft from the open position to the closed position, the permanent magnets cause the shaft to be partially extended for assist in moving the closing member to the closed position.

39. The apparatus as claimed in claim 34, wherein the permanent magnets comprise rare earth material.

40. A door closer adapted to be coupled between a door and a door frame for providing controlled closing of the door, said door closer comprising:

a housing having first and second ends;

a shaft including a shaft portion extending within the housing, the shaft being adapted for axial movement relative to the housing between retracted and extended positions;

a magnet system coupled to the shaft for moving the shaft from one of said positions to the other one of said positions, the magnet system including a plurality of positioning permanent magnets located within the housing and extending in an aligned relationship coaxially with the shaft, each of the permanent magnets having first and second poles of opposite polarities, the permanent magnets being arranged in a repelling configuration with adjacent ones of the permanent magnets having their poles of common polarity located adjacent to one another, whereby repulsion forces produced by adjacent ones of the permanent magnets repel the permanent magnets away from one another, moving the shaft from said one to said other position, the shaft being coupled to the door and the door frame, and the housing being coupled to the door and the door frame, the shaft being moved from said other position towards said one position as the door is opened, moving the permanent magnets towards one another against the repulsive forces produced by the permanent magnets, and the magnet system moving the shaft towards said other position to close the door.

* * * * *